US011104507B2

(12) United States Patent
Farrar et al.

(10) Patent No.: US 11,104,507 B2
(45) Date of Patent: Aug. 31, 2021

(54) CONTAINER FOR HOUSING ARTWORK

(71) Applicant: CRATEIGHT LIMITED, London (GB)

(72) Inventors: Peter Antony Farrar, Leeds (GB); John Hein, Leeds (GB); Andrew Nikita Cunynghame Stramentov, London (GB); Anthony Henry Joseph Fraser, Rutland (GB)

(73) Assignee: CRATEIGHT LIMITED, London (GB)

( * ) Notice: Subject to any disclaimer, the term of this patent is extended or adjusted under 35 U.S.C. 154(b) by 202 days.

(21) Appl. No.: 16/448,554

(22) Filed: Jun. 21, 2019

(65) Prior Publication Data

US 2019/0322445 A1 Oct. 24, 2019

Related U.S. Application Data

(63) Continuation of application No. PCT/GB2017/053434, filed on Nov. 15, 2017.

(30) Foreign Application Priority Data

Dec. 22, 2016 (GB) ..... 1622051

(51) Int. Cl.
*B65D 21/08* (2006.01)
*B65D 85/30* (2006.01)
(Continued)

(52) U.S. Cl.
CPC ..... *B65D 85/30* (2013.01); *B65D 21/0201* (2013.01); *B65D 81/05* (2013.01)

(58) Field of Classification Search
CPC .... B65D 81/05; B65D 85/30; B65D 21/0201; B65D 21/086
(Continued)

(56) References Cited

U.S. PATENT DOCUMENTS 740,868 A 10/1903 Johnson
1,107,686 A 8/1914 Mehrmann
(Continued)

FOREIGN PATENT DOCUMENTS

CH 559308 2/1975
CN 201057588 5/2008
(Continued)

OTHER PUBLICATIONS

GB Patent Application No. 1622051.9 filed Dec. 22, 2016 in the name of Crateight Limited.
(Continued)

*Primary Examiner* — Stephen J Castellano
(74) *Attorney, Agent, or Firm* — Levine Bagade Han LLP

(57) ABSTRACT

A container for housing an artwork during transportation or storage, the container comprising four side parts and four corner parts for connecting the side parts to form a substantially rectangular frame; a substantially rectangular lid part and a substantially rectangular mounting panel, each of the side parts having a first recess extending along its length for receiving a respective edge of the lid part and a second recess extending along its length for receiving a respective edge of the mounting panel; a first resilient member for locating around the perimeter of the lid part between the lid part and the substantially rectangular frame; a second resilient member for locating around the perimeter of the mounting panel between the mounting panel and the substantially rectangular frame so as to act as a shock absorber between the mounting panel and the substantially rectangular frame; and securing means for securing the lid part in a closed position relative to the substantially rectangular frame.

20 Claims, 10 Drawing Sheets

(51) Int. Cl.
*B65D 21/02* (2006.01)
*B65D 81/05* (2006.01)

(58) Field of Classification Search
USPC ..... 220/4.28
See application file for complete search history.

(56) References Cited

U.S. PATENT DOCUMENTS

| | | | | |
|---|---|---|---|---|
| 3,655,034 | A | 4/1972 | Stollman et al. | |
| 4,156,498 | A | 5/1979 | Miller | |
| 4,474,492 | A | 10/1984 | Fleitas | |
| 4,557,457 | A | 12/1985 | Cockfield et al. | |
| 4,641,807 | A | 2/1987 | Phillips | |
| 5,259,523 | A | 11/1993 | Scherb | |
| 5,314,159 | A | 5/1994 | Szarata | |
| 6,651,948 | B2 | 11/2003 | Szarata | |
| 6,808,074 | B1 * | 10/2004 | Schwartz | A47F 3/005 206/577 |
| 2002/0009346 | A1 | 1/2002 | Holt et al. | |
| 2007/0281580 | A1 | 12/2007 | Sambenedetto | |
| 2010/0116964 | A1 | 5/2010 | Aleo | |
| 2012/0153108 | A1 | 6/2012 | Schneider | |
| 2014/0001134 | A1 * | 1/2014 | Merey | A47B 97/00 211/86.01 |
| 2015/0034636 | A1 | 2/2015 | Aaland et al. | |
| 2015/0223583 | A1 | 8/2015 | Greenfield et al. | |
| 2015/0300559 | A1 | 10/2015 | Callif et al. | |

FOREIGN PATENT DOCUMENTS

| | | |
|---|---|---|
| CN | 102493984 | 6/2012 |
| CN | 203094632 | 7/2013 |
| CN | 205345757 | 6/2016 |
| CN | 205499854 | 8/2016 |
| DE | 4141573 | 6/1993 |
| DE | 202012002687 | 8/2013 |
| EP | 0518803 | 12/1992 |
| EP | 1074204 | 2/2001 |
| GB | 2116247 | 2/1986 |
| GB | 2535855 | 8/2016 |
| JP | 2001248613 | 9/2001 |
| WO | WO 1998/034853 | 8/1998 |
| WO | WO 2012/087163 | 6/2012 |

OTHER PUBLICATIONS

GB Patent Application No. 1704477.7 filed Mar. 21, 2017 in the name of Crateight Limited.

* cited by examiner 10
10D
11
11D
12
12D
12E
13
13D
13E
14
15
16
16B
17
18
22

CONTAINER FOR HOUSING ARTWORK

CROSS-REFERENCE TO RELATED APPLICATIONS

This application is a continuation of International Patent Application Number PCT/GB2017/053434 filed Nov. 15, 2017, which claims priority to GB Patent Application Number 1622051.9 filed Dec. 22, 2016, the contents of which are incorporated herein by reference in their entirety.

BACKGROUND OF THE INVENTION

This invention relates to a container for housing artwork during transportation and storage.

There are a number of known ways of packaging artwork for transportation and storage. These can be broadly be described as soft packing and hard packing. With soft packing a protective layer of material (typically tissue paper, polyethene, bubble wrap, synthetic non-tear wrap material, and card) is wrapped around the artwork and held in place by adhesive tape.

There are three main forms of hard packing: a 'gallery or standard' case, a T-frame and a 'museum specification' case. A gallery case is a wooden box which is filled with a shock absorbing material e.g. foam or polystyrene, that encases the artwork. In a T-frame, the artwork is secured to a wooden construction by fixing brackets attached to the frame or stretcher of the artwork. The T-frame may have polyethene attached to its surface or may be encased in polyethene. A museum case is essentially an inner case within an outer case so providing a double layer of protection. The artwork is placed in a gallery or standard case and this is then inserted into another case with a further layer of foam on the internal surfaces. Alternatively, a T-frame may be housed in the outer case. The cases typically have additional layers of foam on the internal surfaces and foil or foam gaskets can be applied to edges of the case to provide water resistance.

In another arrangement, the corners of the frame of the artwork are located in blocks of resilient material which are positioned on a backing plate of a container and affixed thereto, eg by hook and loop fasteners. Further blocks of resilient packaging material are then located over the corners of the artwork, so the artwork is sandwiched between the blocks and these further blocks are then held in place by a lid of the container.

Such known packaging is usually assembled and constructed by specialist art packaging and shipping firms and in many cases the container is effectively custom built for the particular application. Such packaging can thus be very expensive. Also, as the artwork may be of very high value, insurance companies have a significant influence over the manner in which the artwork is packed.

BRIEF SUMMARY OF THE INVENTION

An embodiment of the present invention aims to provide a container which enables an artwork to be housed in an improved manner, eg so that the quality of the manner in which the artwork is housed is less dependent on the skill and expertise of the people mounting it within a container. In preferred forms of the apparatus, it enables a high quality container to be provided at lower cost and/or which can be easily adapted to accommodate artworks of different sizes and/or can be easily adjusted to hold an artwork of a different size and so can be re-used.

According to a first aspect of the invention, there is provided a container for housing an artwork during transportation or storage, the container comprising:

four side parts and four corner parts for connecting the side parts to form a substantially rectangular frame;

a substantially rectangular lid part and a substantially rectangular mounting panel, each of the side parts having a first recess extending along its length for receiving a respective edge of the lid part and a second recess extending along its length for receiving a respective edge of the mounting panel;

a first resilient member for locating around the perimeter of the lid part between the lid part and the substantially rectangular frame;

a second resilient member for locating around the perimeter of the mounting panel between the mounting panel and the substantially rectangular frame so as to act as a shock absorber between the mounting panel and the substantially rectangular frame; and securing means for securing the lid part in a closed position relative to the substantially rectangular frame.

The container preferably also comprises a substantially rectangular base part, each of the side parts having a third recess extending along its length for receiving a respective edge of the base part, and a third resilient member for locating around the perimeter of the base part between the base part and the substantially rectangular frame.

The second resilient member is preferably adapted to permit movement of the mounting panel relative to the substantially rectangular frame in three dimensions so as to substantially isolate the mounting panel from shock forces experienced by the container.

Each corner part may be securable to the ends of adjacent side parts by fasteners, eg by bolts Each corner part may be integrally formed with a side part and be securable to the end of an adjacent side part by fasteners. Two of the side parts may each have an integrally formed corner part at each end.

At least some of the side parts and/or corner parts may have a recess therein for providing a hand hold to facilitate handling of the container.

Said securing means may comprise one or more latches mounted on a side member and engageable with a major face of the lid part.

The side parts are preferably shaped to provide channels for receiving straps encircling the container, preferably with at least one strap around the length of the container and at least one strap around the width of the container.

One or more of the securing means may be located in a channel so, in use, a strap located within the channel lies over the securing means.

The side parts are preferably shaped so that a plurality of similar size containers can be stacked together.

The corner parts and/or the side parts may be shaped so that adjacent containers in a stack of containers interlock with each other.

At least some of the corner parts may be shaped, or have corner extensions fitted thereto, so as to provide feet on which the container can be stood and/or a channel beneath a stack of similar size containers for receiving prongs of a lifting machine.

The mounting panel is preferably provided with a plurality of retention members to which fastening devices secured to an artwork can be releasably secured. The retention members may be provided by an array of parallel slots or apertures.

The retention members are preferably arranged so that artworks of a variety of sizes or shapes can be secured in a selected position on the mounting panel spaced from the side parts of the container.

The mounting panel may comprise a metal plate mounted on a composite panel and the metal plate may comprise an aluminium extrusion. The side parts may be formed of a plastics material and the corner parts may be formed of metal. And the lid part and base part (when provided) may comprises a composite panel.

The first, second and third resilient members may comprise a resilient rubber or plastic material.

The invention also provides a kit of parts for forming a container as described above.

The kit of parts may comprise side parts of at least two lengths, L1 and L2, whereby rectangular containers having internal dimensions of substantially L1×L1, L2×L2 and L1×L2 can be fabricated.

The side parts having a length L2 may be formed from two side parts of length L1 joined end to end by a connector part.

Other preferred and optional features of the invention will be apparent from the following description and from the subsidiary claims.

Reference is also made to co-pending applications GB 1704477.7 and GB 1622050.1 which describe and claim a particular form of fastening device for attaching to an artwork and apparatus comprising securing devices for securing the artwork to a mounting panel via said fastening devices. The present invention relates to a container in which a subassembly comprising the artwork mounted on a mounting panel can be housed. The subassembly may be constructed according to said co-pending applications but the container can also house other arrangements which comprise a mounting panel.

BRIEF DESCRIPTION OF THE SEVERAL VIEWS OF THE DRAWINGS

The invention will now be further described, merely by way of example, with reference to the accompanying drawings in which.

DETAILED DESCRIPTION OF THE INVENTION

The apparatus described herein is designed to hold an artwork during transportation and storage. The artwork typically has a frame to which a plurality of fastening devices have been secured. The fastening devices are then secured to a mounting panel and the container described herein is designed to house an artwork mounted on a mounting panel. In the present application the mounting panel is in the form of a metal plate with a series of parallel slots in an upper surface thereof. Such a plate is conveniently formed by an extrusion process from aluminium. However other forms of mounting panel may be used.

Figures 1, 2:
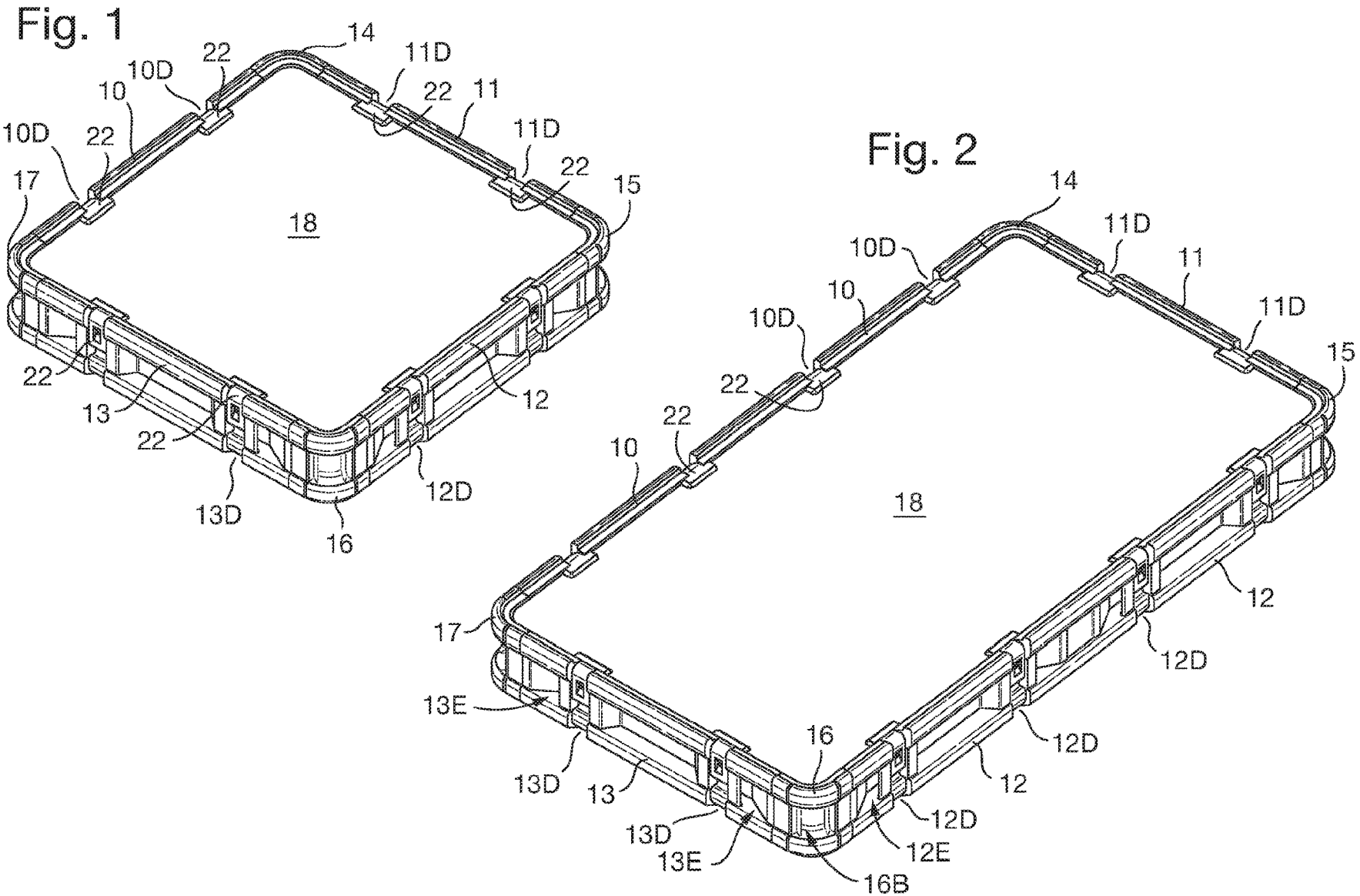
FIGS. 1 and 2 are perspective views of embodiments of containers according to the present invention, the first having sides of similar lengths and the second having sides of different lengths.
Figure 3:
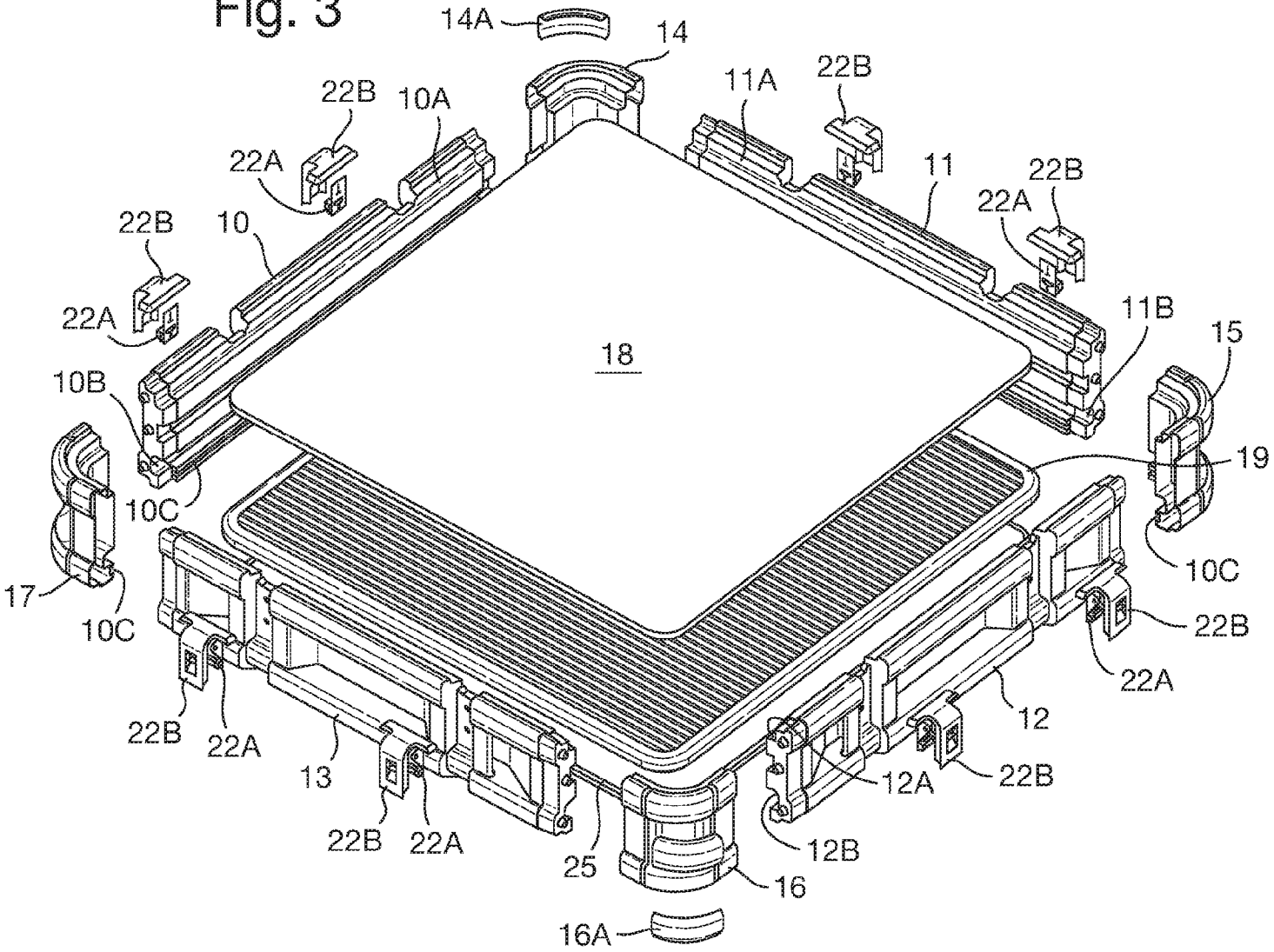
FIG. 3 is an exploded view of the container shown in FIG. 1, including a mounting panel for mounting therein.

FIGS. 1 and 3 show a container comprising four side parts 10, 11, 12, 13 and four corner parts 14, 15, 16, 17 for connecting the side parts (by means of fasteners—not shown) to form a substantially rectangular frame. In an alternative arrangement, each of the corner parts 14, 15, 16, 17 may be integrally formed with one of the side parts 10, 11, 12, 13 and arranged to be connected to an adjacent side part 10, 11, 12, 13. For example, each side part 10, 11, 12, 13 may be formed with an integral corner part 14, 15, 16, 17. In another arrangement, two of the side parts may be formed with a corner part at each end and the other two parts may be configured to be connected to the corner parts. Forming the substantially rectangular frame from side parts with integrally formed corner parts may beneficially reduce the cost of manufacturing the components for the container, may reduce the time and/or cost of assembling the container and/or may improve the rigidity of the container.

Figure 5:
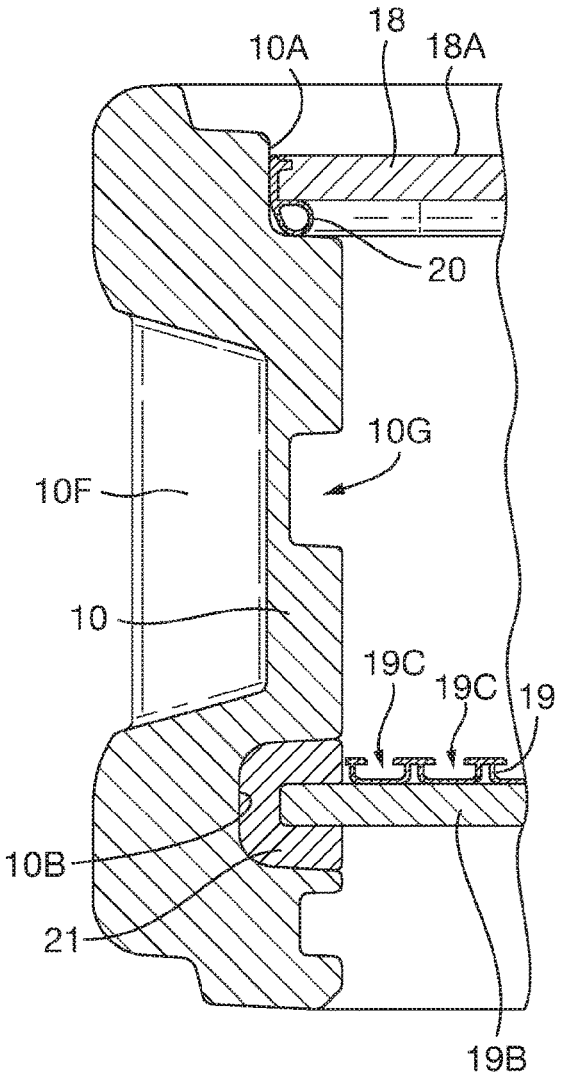
FIG. 5 is a cross-sectional view through one side of a modified form of the container shown in FIG. 3.

The container also comprises a substantially rectangular lid part 18 and a substantially rectangular mounting panel 19. Each of the side parts has a first recess 10A, 11A, 12A, 13A extending along its length for receiving a respective edge of the lid part 18 and a second recess, in the form of a groove 10B, 11B, 12B, 13B, extending along its length for receiving a respective edge of the mounting panel 19. As shown in FIG. 5, a first resilient member 20 is located around the perimeter of the lid part 18 between the lid part and the substantially rectangular frame, the first resilient member 20 being located in the first recess 10A, 11A, 12A, 13A and providing a seal between the lid part 18 and the frame.

A second resilient member 21 is located around the perimeter of the mounting panel 19 between the mounting panel 19 and the substantially rectangular frame, the second resilient member 21 is located in the second recess or groove 10B, 11B, 12B, 13B and acts as a shock absorber between the mounting panel and the substantially rectangular frame. The second resilient member 21 is adapted to permit movement of the mounting panel 19 relative to the substantially rectangular frame in three dimensions so as to substantially isolate the mounting panel 19 from shock forces experienced by the container.

Securing means in the form of latches 22 are provided for securing at the lid part 18 in a closed position relative to the substantially rectangular frame. The latches 22 are mounted on one or more of the side parts 10, 11, 12, 13 and engage the major, external face 18A of the lid part 18. Preferably, at least eight latches 22 are provided, two on each side part.

In order to house an artwork in the container shown, the container is constructed by selecting a mounting panel of the desired size, fitting the second resilient member onto the periphery of the mounting panel and then assembling side parts of the appropriate lengths and corner parts onto the edges of the mounting panel with the second sealing member fitted into the second recesses of the side parts. The corner parts are then fastened to the side parts with bolts or other fasteners. The lid part can then be placed in the first recess (the upper side of which is open) and secured in place by the latches (the latches being pre-fitted to the side parts). In other arrangements (not shown), the lid part may be hinged to one of the side parts. Assembly of embodiments having a separate base part is similar except that the side parts and corner parts are assembled onto the edges of both the mounting panel and the base part, with the base part (and the third resilient member mounted thereon) being located in the third recesses of the side parts.

Figure 4:
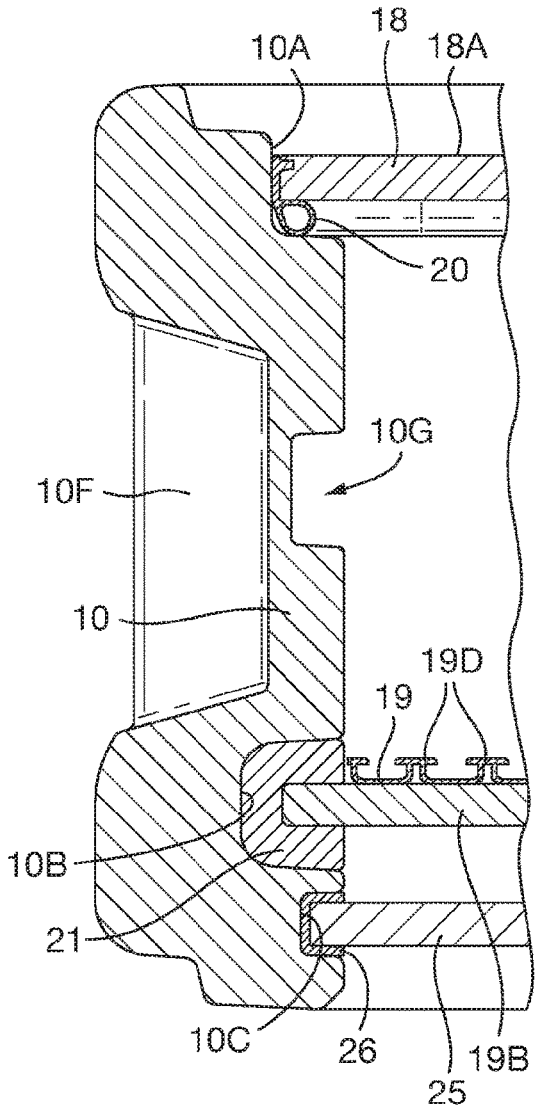
FIG. 4 is a cross-sectional view through one side of the container shown in FIG. 3.

In a typical arrangement, the side parts may be formed from a plastic material, eg they may be blow moulded from a plastics material such as high-density polyethylene. Such side parts will thus be of generally hollow construction. In order to help stiffen the side parts, recesses 10F and 10G are formed in opposite side thereof (as shown in FIGS. 4 and 5) to narrow the cross-section of a central portion of the side part. The corner parts may be formed of metal, eg by as aluminium castings. The lid part may comprise a composite panel and the mounting panel may comprise a metal plate mounted on a composite panel. The corner parts may also be provided with rubber 'overmould' parts, eg as shown at 14A and 16A in FIG. 3, to give the corner parts impact resistance and provide them with a non-slip surface.

The first resilient member serves to provide an air-tight seal between the lid part and the frame formed by the four side parts and is preferably compressible by the lid part when the latches are holding the lid part in the closed position. The first resilient member may be a silicone moulding with a hollow portion to provide compressibility but a wide variety of other forms of resilient sealing means may be used.

As mentioned above the primary function of the second resilient member is to insulate the mounting panel from shock forces experienced by the container. It therefore is of larger dimensions than the first resilient member and may be formed of a softer material, eg a softer silicone moulding or a foamed silicone (although again a wide variety of other forms of resilient means could be used to provide these functions).

In arrangements, the second resilient member may provide a thickness of resilient material between the mounting panel and the wall of the groove in which it is located in the range 5-40 mm. For an arrangement such as that depicted in FIG. 5 it may typically be in the range 10-20 mm (both above and below and to the edge of the mounting panel). In an arrangement such as that depicted in FIGS. 11 to 13 discussed below, the thickness of resilient material between the mounting panel and the wall of the groove in which it is located may be in the range 20 to 40 mm. Preferably the second resilient member is adapted to permit movement of the mounting panel of at least 5 mm and preferably 10, 15 or 20 mm in three dimensions relative to the rectangular frame of the container. Such movement may comprise at least 50% of the thickness of the resilient material and maybe 75% or more of the thickness of the resilient material.

As mentioned, an artwork is mounted on the mounting panel by means of fastening devices (not shown). This may significantly increase the weight of the art work and hence its inertia. The mounting panel is then, in effect, suspended in the container by its location within the second resilient member which acts as a shock absorber to isolate the mounting panel (and hence the artwork) from shock forces experienced by the container. Thus, while the subassembly comprising the artwork and the mounting panel is relatively rigid and the rectangular frame formed by the side parts and corner parts is substantially rigid, there is no rigid connection between the mounting panel and the rectangular frame. Such an arrangement is thus effective in protecting the artwork from shock forces, eg whilst the container is in transit or should the container be stood on a side part and then fall over.

As shown in FIG. 4, the mounting panel 19 comprises a metal plate 19A secured to a composite panel 19B, the perimeter of which is located in the second resilient member 21. The mounting panel is provided with a plurality of retention members to which fastening devices mounted on the frame of an artwork (not shown) can be secured. In the arrangement shown, the retention members comprise an array of parallel slots (or apertures) 19C in the plate 19A with flanges 19D either side of each slot. In a preferred arrangement, the plate has a substantially uniform cross-section throughout its length so it can be formed by an extrusion process, eg from aluminium. Such retention members have the advantage that artworks of a variety of sizes or shapes can be secured in any selected position on the mounting panel spaced from the side parts of the container.

In the embodiment shown in FIG. 4, the container is also provided with a base part 2 and each of the side parts has a third recess or groove 10C, 11C, 12C, 13C extending along its length for receiving a respective edge of the base part 25, and a third resilient member 26 is located around the perimeter of the base part 25 between the base part 25 and the substantially rectangular frame. The base part 25 helps protect the mounting panel 19 (and the artwork mounted thereon) from direct impact from beneath the mounting panel. The mounting panel (and an artwork thereon) is thus protected from impact on any part of the exterior of the container, the second resilient member isolating it from all shock forces applied to the lid parts side parts or base part of the container. The base part is also preferably formed of a composite panel (which is resistant to impact or piercing). The composite panels of the lid part, mounting panel and base part may typically have a thickness of around 10-15 mm.

The third resilient member also serves to provide an air-tight seal between the base part and the frame formed by the four side parts. The third resilient member may be a silicone moulding but does not need to be substantially compressible like the first resilient member. Again, a wide variety of other forms of resilient sealing means may be used.

In a modified version (not shown) of the arrangement shown in FIG. 4, the composite panel 19B may be omitted so the mounting panel 19 comprises just the metal panel 19A, the perimeter of which is located in the second resilient member 21.

FIG. 5 shows a cross-section similar to that of FIG. 4 of another embodiment in which the base plate 25 is omitted. In this case, the mounting panel 19 also forms the base part of the container and the mounting panel preferably comprises a metal plate 19A and composite panel 19B as shown. In this case, the second resilient member 21 also needs to provide an air-tight seal as well as cushioning the mounting panel.

Figure 6:
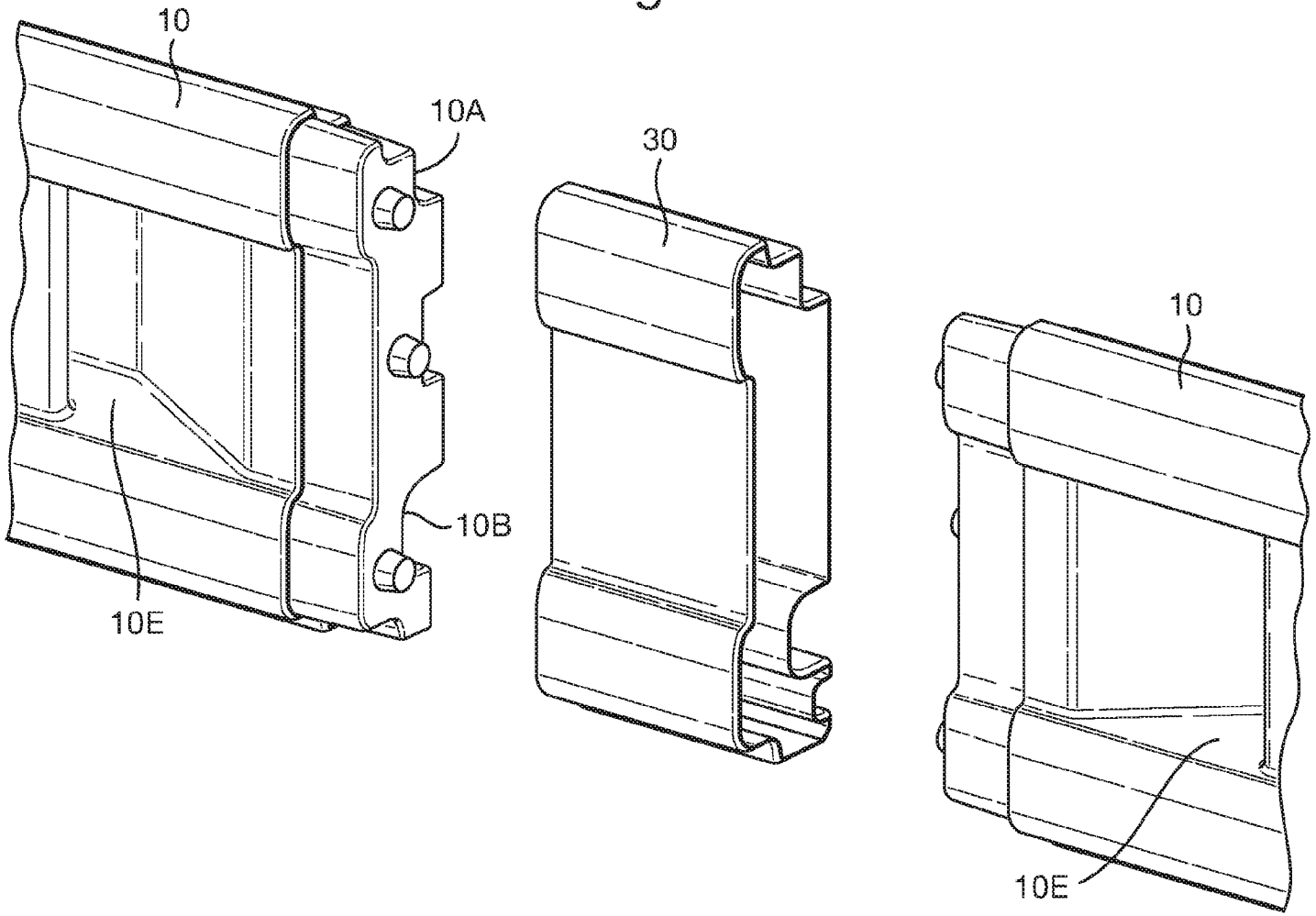
FIG. 6 is an exploded view of part of one of the longer sides of the container shown in FIG. 2.

FIG. 2 shows a container similar to that of FIG. 1 except that it is longer than it is wide. Such a container may be formed in the same manner as described above (and illustrated in FIG. 3) except that two longer side parts are used. One way of providing longer side parts is to connect two shorter side parts 10 by a joining part 30 as illustrated in FIG. 6, the two side parts being secured to the joining part by fasteners, eg similar to those used to join the corner parts to the side parts. If the shorter side pars have a length L, it is thus possible to construct containers having dimensions L×L (FIG. 1), 2L×L (FIG. 2) and 2L×2L (not shown).

Figure 7A:
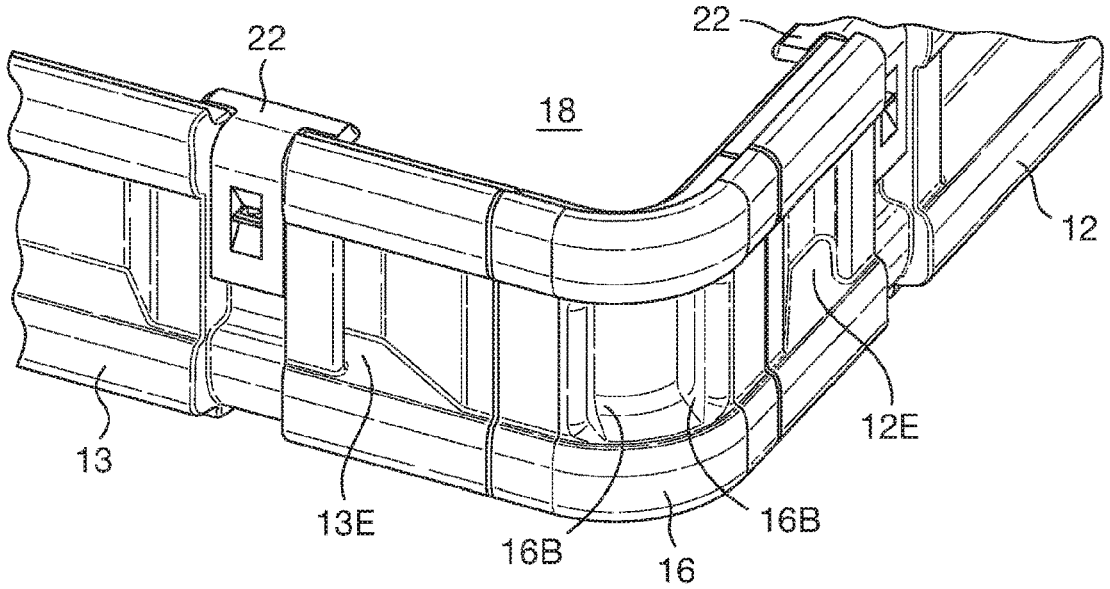
FIG. 7A is an enlarged perspective view of a corner of the container shown in FIG. 1 or 2 and FIG. 7B a cross-section therethrough.
Figure 7B:
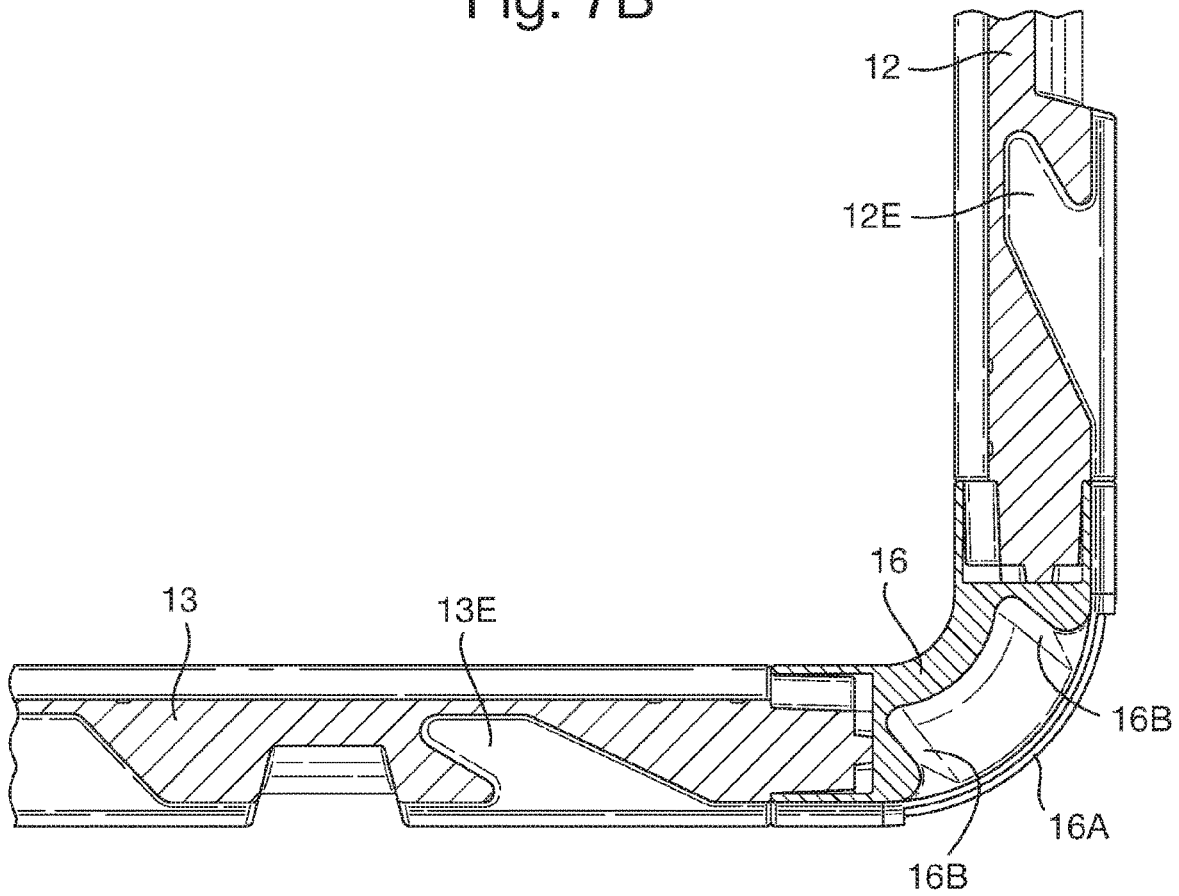

As best shown in FIGS. 7A and 7B, the side parts 10, 11, 12, 13 are preferably provided with recesses 10E, 11E, 12E, 13E towards the ends thereof near where they connect with the corner parts, these recesses providing handles accessible by a user's fingers to assist in lifting the container. These recesses are preferably used in conjunction with further recesses 14B, 15B, 16B, 17B provided in the corner parts 14, 15, 16, 17. The recesses 13E, 16B in a side part 13 and the corner part 16 connected thereto enable the user to grasp the container. Other forms of recess and/or handles may be provided to on the side parts and/or the corner parts to facilitate handling of the container.

The latches 22 can be of other forms. However, in an arrangement, such as that shown in FIGS. 3, 7A, 9 and 10, they may comprise a mounting part 22A which is mounted on one of the side parts and a substantially L-shaped pivoting part 22B one arm of which is pivotally connected to the mounting part and the other arm of which is arranged to swing over and lie adjacent the outwardly facing major surface of the lid part. This arrangement has the advantage of being very simple as it only requires a component attached to the side part of the container, the lid part being retained in the closed position merely by locating the pivoting part adjacent the surface of the lid part. The latches 22 may be held in the closed position by an over-centre arrangement and/or may be lockable in the closed position.

Figure 9:
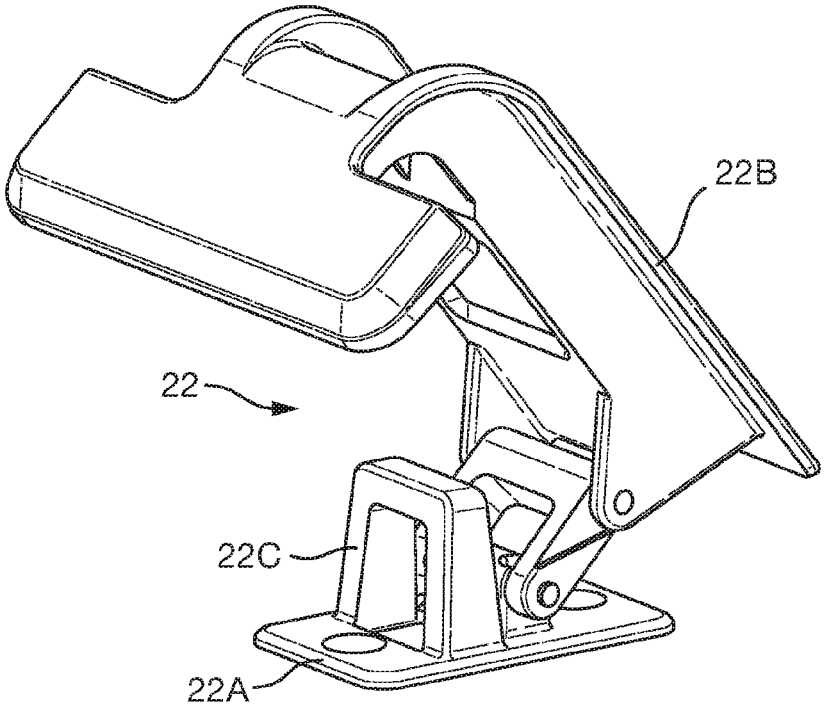
FIGS. 9 and 10 depict an arrangement of a latch that may be used to secure the lid part in a closed position.
Figure 10:
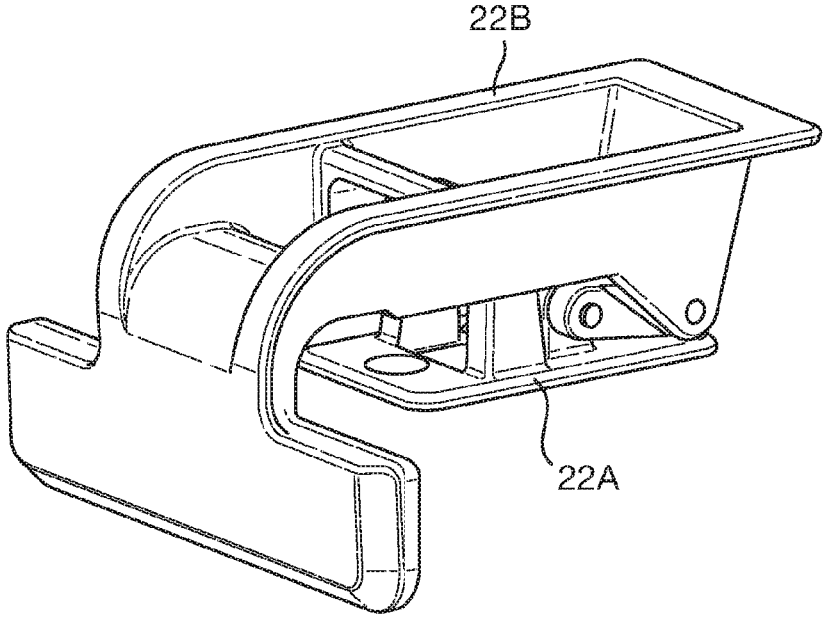

For example, as shown in FIGS. 9 and 10, the mounting part 22A of the latch 22 may include a loop 22C that passes through an opening in the pivoting part 22B. The mounting part 22A and the pivoting part 22B may be configured such that a component inserted in the loop 22C would prevent the pivoting part 22B from pivoting relative to the mounting part 22B, which is necessary to release the latch 22. One or more latches 22 may be secured by passing through the loop a tamper-proof seal, a lock such as a padlock or a cable tie. Multiple latches 22 may be secured by passing a wire, cable, cord or tape through the loops 22C of each of the latches 22 and then securing the ends of the wire, cable, cord or tape with a tamper-proof seal, a lock such as a padlock or a cable tie.

Figure 8:
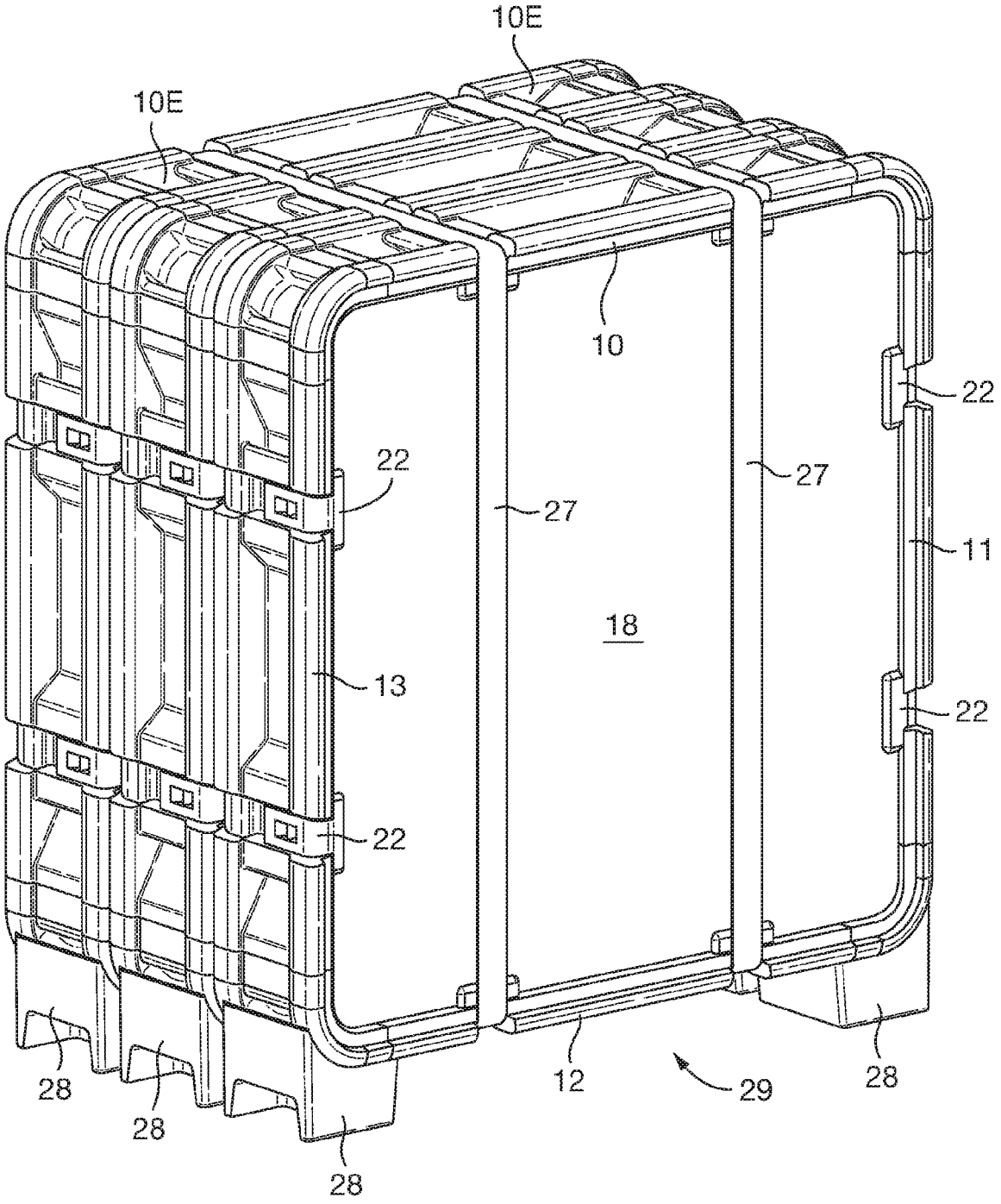
FIG. 8 is a perspective view of a plurality of containers such as shown in FIG. 1 when stacked together.

The side parts of the container are also preferably shaped to provide channels 10D, 11D, 12D, 13D for receiving straps (see FIG. 8) encircling the container. Preferably at least one strap passes around the length of the container and at least one strap passes around the width of the container or, as shown in FIG. 8, a strap may pass around a stack of containers to help hold them together. As shown in the Figures, at least some of the latches 22 are located in one of these channel so that when a strap is positioned in a channel it lies over the latch 22 and thus provides a further level of security in keeping the latches in the closed position and protecting the latches from being tampered with.

The side parts of the container are also preferably shaped so that a plurality of similar size containers can be stacked together, ie with the lid and base parts thereof lying parallel to each other as shown in FIG. 8. The stack of containers can be secured together by straps 27 located in the channels described above. Alternatively, or additionally, the side parts and/or the corner parts may be shaped so that adjacent containers in a stack of containers interlock with each other, eg by means of push-fit projections and recesses (not shown). At least some of the corner parts are also preferably shaped, or have extension parts 28 fitted thereto which act as feet on which the stack can stand and provide a channel 29 beneath the stack of containers for receiving the prongs of a lifting machine such as a fork lift truck.

Figure 11:
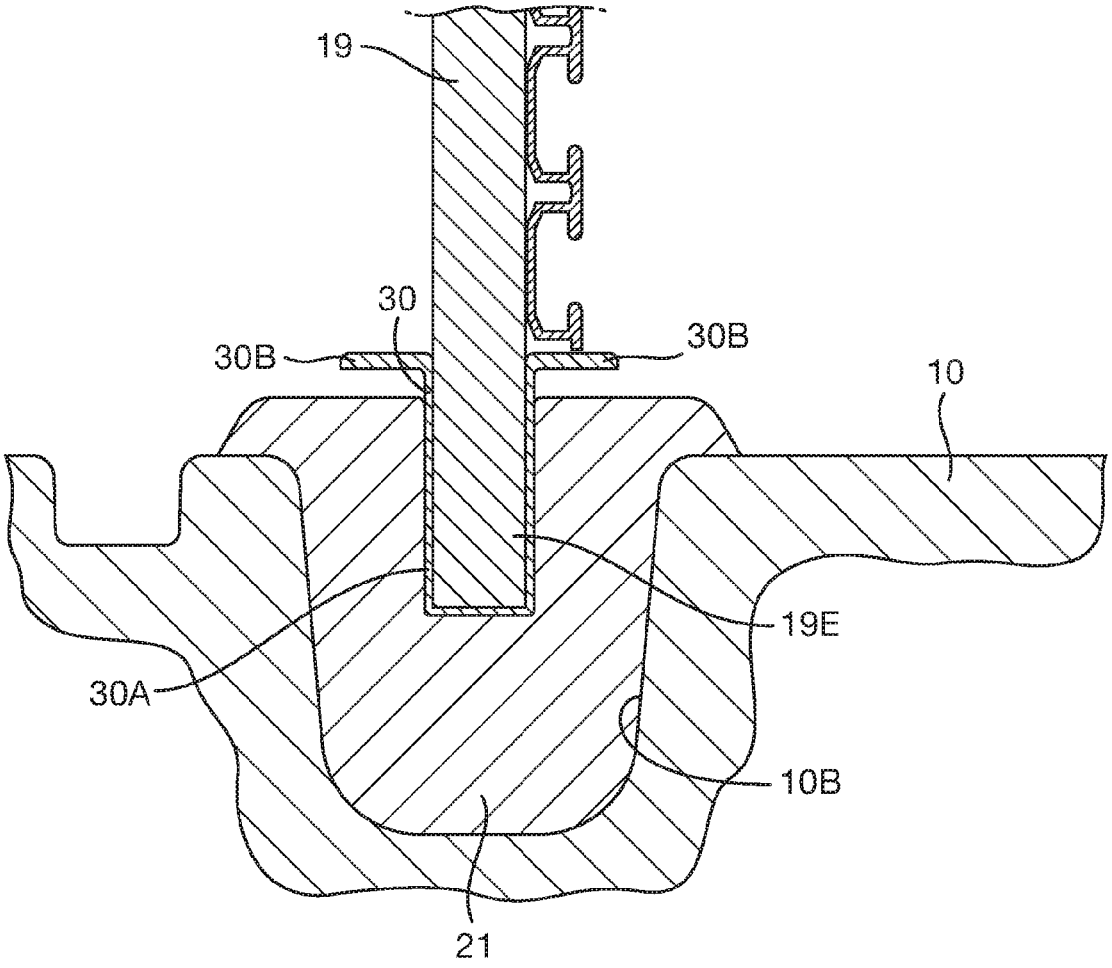
FIG. 11 is an enlarged view of a cross-section of an edge region of a mounting panel including an optional displacement controller.

FIG. 11 depicts a detail of an optional arrangement of the engagement of the mounting panel 19 to the second resilient member 21. As shown, in this arrangement, a displacement controller 30 may be mounted between an edge of the mounting panel 19 and the second resilient member 21.

The displacement controller 30 may have a section 30A that is mounted to a region 19E of the mounting panel 19 adjacent its edge. In the arrangement depicted in FIG. 11, first section 30A of the displacement controller 30 mounted to the edge of the mounting panel 19 has a U-shape in cross-section such that it surrounds the edge of the mounting panel 19. Other arrangements may also be used in which the displacement controller 30 is mounted to and abuts a portion of the edge of the mounting plate 19.

The displacement controller 30 includes at least one protrusion 30B that protrudes away from a major face of the mounting panel 19. In the arrangement depicted in FIG. 11, the displacement controller 30 includes protrusions 30B that protrudes away from both major faces of the mounting panel 19, namely has two protrusions 30B extending in opposite directions from opposite sides of the mounting panel 19.

The protrusions 30B of the displacement controller 30 may be configured such that, when the displacement controller 30 is engaged with the edge region 19E of the mounting panel 19 and connected to the second resilient member 21, the protrusions 30B of the displacement controller 30 do not contact the second resilient member 21. In particular, as shown in FIG. 11, when the second resilient member 21 is uncompressed or only compressed a small amount, there may be a separation between the second section 30B of the displacement controller and the second resilient member 21.

In such an arrangement, the second resilient member 21 may be compressed by movement of the mounting panel 19 towards the second resilient member 21. After an initial compression of the second resilient member 21, the protrusions 30B of the displacement controller 30 contact the surface of the second resilient member 21. In such an arrangement, the resistance to compression provided by the second resilient member 21 may be significantly greater when the protrusions 30B of the displacement controller contact and compress the second resilient member 21 than when there is a separation between the protrusions 30B of the displacement controller 30 and the second resilient member 21. In the latter situation only the edge of the mounting panel 19 may be compressing the second resilient member 21.

Such an arrangement may enable the container to function in a desirable manner under two different sets of conditions. Under normal conditions, the container may not be subject to large external forces but may, particularly during transit, be subject to vibrations. Under these conditions, the second resilient member 21 may not be sufficiently compressed that the protrusions 30B of the displacement controller 30 engage with the second resilient member 21. The stiffness of the connection between the mounting panel 19 and the side part 10 is therefore relatively low, reducing the level of vibration that is transmitted from the side part 10 to the mounting panel 19 and therefore to the artwork.

However, in the event of a larger impact to the container, such as a drop impact, the protrusions 30B engage with the second resilient member 21, increasing the stiffness of the connection between side part 10 and the mounting panel 19. Increasing the stiffness of the connection under higher loads increases the maximum impact force that may impact the side part 10 without the second resilient member 21 becoming so compressed that it cannot be compressed further. Beyond that limit, the impact on the container is transmitted to the mounting panel 19 and therefore to the artwork.

In an arrangement, the displacement controller 30 may be mounted only to the bottom edge of the mounting panel 19. This may be the edge for which it is most beneficial because it may only be the bottom edge that is subject to relatively large impact loads, for example if the container is dropped.

In an alternative arrangement, a displacement controller 30 may also be mounted to the top edge of the mounting panel 19. Such an arrangement may be beneficial, for example to reduce potential problems caused by a resonant response of the connection between the mounting panel 19 and the side parts 10, 11, 12, 13. In particular, if the container is subject to vibrations at, or close to, the resonant frequency of the connection of the side parts 10, 11, 12, 13 to the mounting panel 19 by way of the second resilient member 21, an amplified response to the input vibration could result in the second resilient member 21 reaching the limit discussed above in relation to impact loading, resulting in loading being transmitted to the artwork. In an arrangement having a displacement controller 30 provided on the top and bottom edges, the amplified response of the input vibration will result in the protrusions 30B of the displacement controller 30 contacting the second resilient member 21, increasing the stiffness of the connection and damping the vibration of the mounting panel 19 and any artwork mounted thereon.

It should be appreciated, however, that in other arrangements, further displacement controllers 30 may be provided. For example, a displacement controller 30 may be provided to each of the sides of the mounting panel 19. This may permit the container to be used in any orientation.

Figure 13:
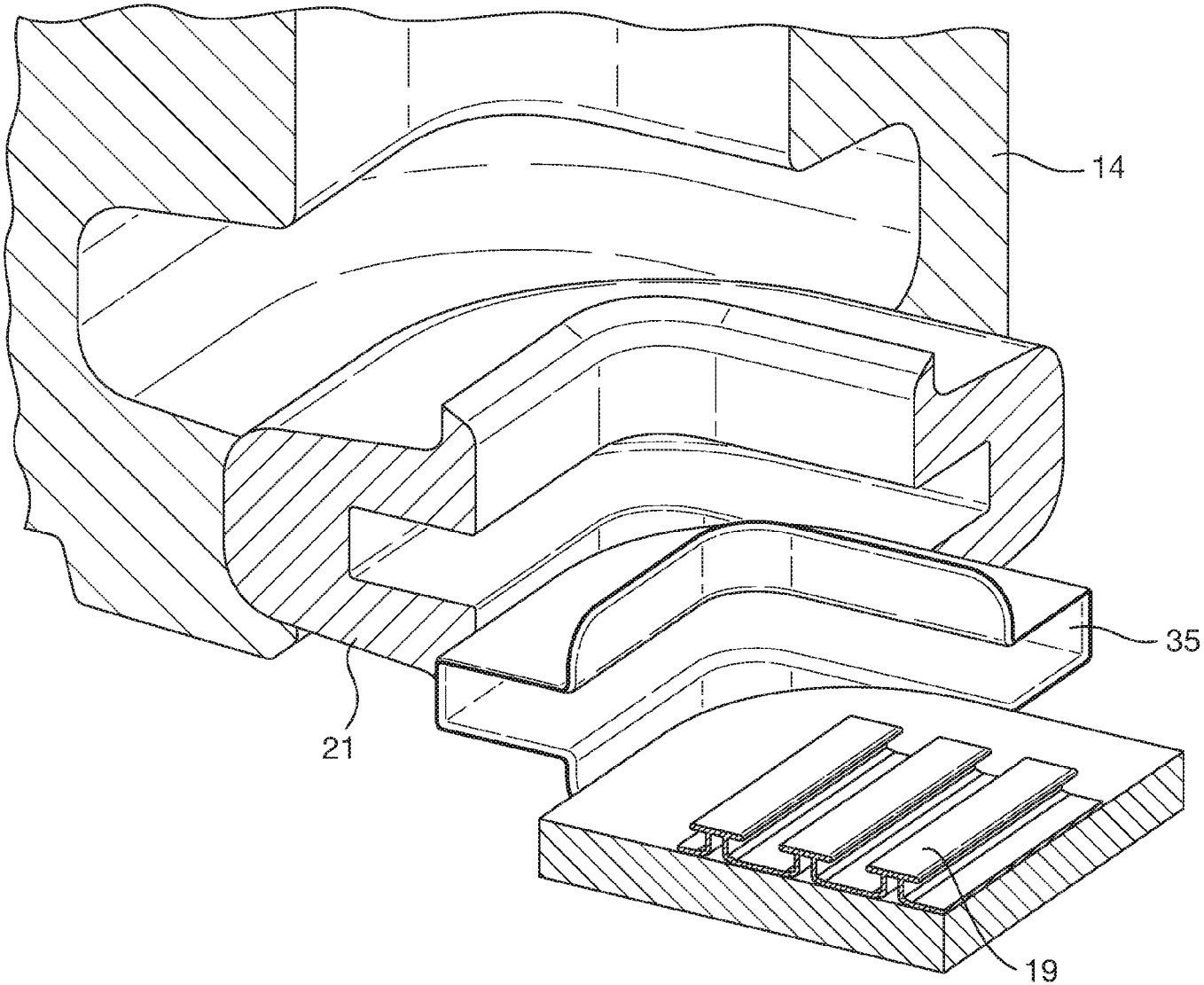
FIG. 13 depicts an exploded view of an arrangement of a displacement controller for use in conjunction with a corner part.

Alternatively or additionally, as depicted in FIG. 13, in an arrangement a displacement controller 35 may be provided at one or more of the corners of the mounting panel 19. Such a corner mounted displacement controller may be provided between a corner of the mounting panel 19 and the second resilient member 21 at the point at which the second resilient member 21 is provided within a corner part 14, 15, 16, 17 of the container. The corner mounted displacement controllers may be beneficial for protecting against drop impacts in a similar manner to that described above but in which the container is dropped on one of its corners rather than on one of the side parts 10, 11, 12, 13.

Figure 12:
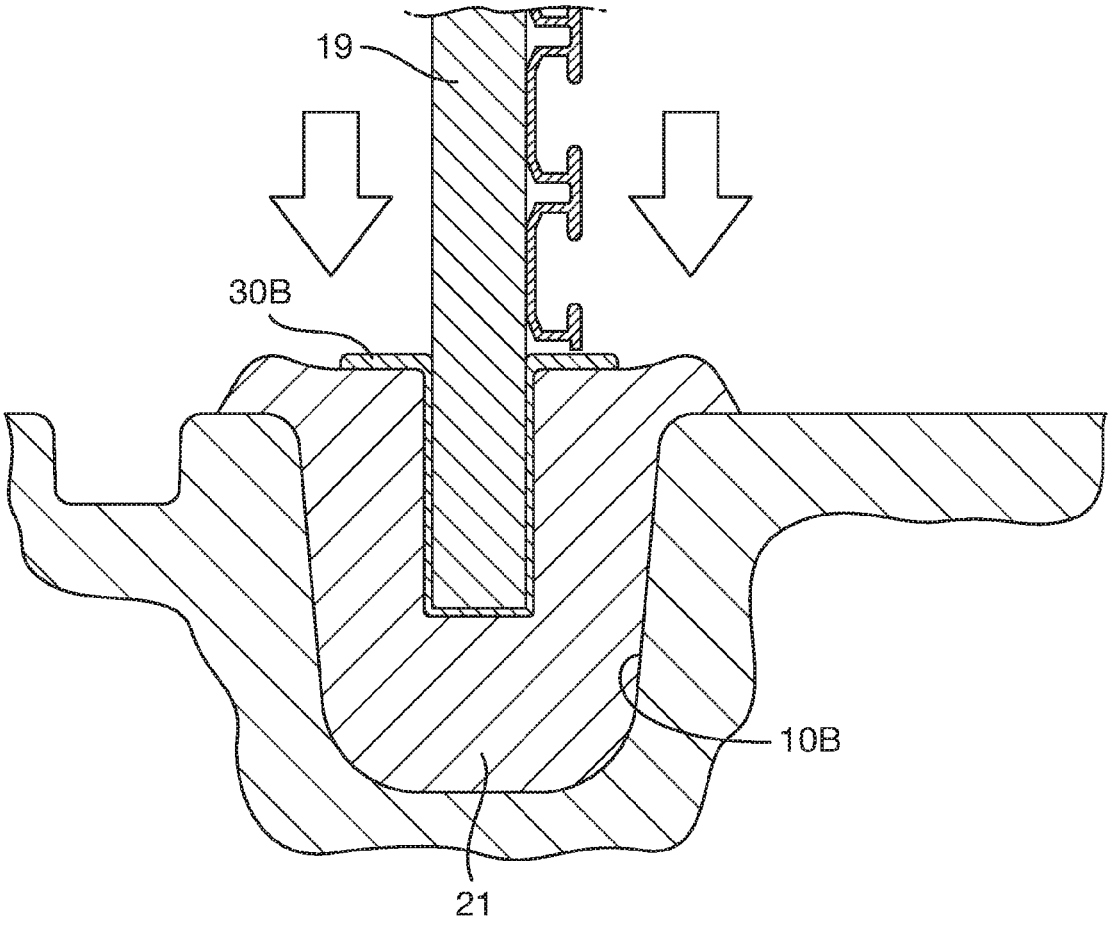
FIG. 12 depicts the arrangement of FIG. 9 under an impact load.

In an arrangement, a displacement controller 30 provided along one edge of the mounting panel 19 may be formed from an extrusion made from, for example, aluminium or a rigid plastic. As shown in FIGS. 11 and 12, its cross-section may be in the form of a U-shaped section 30A that engages with the edge region 19E of the mounting panel 19 and protrusions 30B that extend away from the major faces of the mounting panel 19. Such an arrangement may be convenient to form and may be convenient to include in the process for assembling the container. It will be appreciated, however, that alternative arrangements may be provided, including arrangements in which one or more protrusions 30B are mounted directly to a major face of the mounting plate 19 and/or in which the mounting plate 19 is formed with integral protrusions. In general, at least the protrusions 30B of the displacement controller may have a higher stiffness than the second resilient member 21.

As discussed above, an arrangement including a displacement controller 30 may enable the container to perform well under multiple loading conditions. This may be facilitated by enabling tuning of the responses of the container to the different loading conditions.

Tuning the responses of the container to different loading conditions may be achieved, for example, by selection of the size of the protrusions 30B relative to the width of the channel 10B within which second resilient member 21 is mounted. Alternatively or additionally, tuning of the responses may be achieved by selection of the initial separation between the protrusions 30B and the surface of the second resilient member 21 in an unloaded state. Alternatively or additionally, tuning of the responses may be achieved by selection of the length of the displacement controller 30 relative to the length of the side part 10, 11, 12, 13 to which it is mounted. In particular, the displacement controller 30 may be shorter than the side part 10, 11, 12, 13 with which it is associated and/or plural relatively short displacement controllers 30 may be provided for one side member. Alternatively or additionally, tuning of the responses may be achieved by selecting the stiffness of the displacement controller 30.

In an arrangement, a range of displacement controllers 30 may be provided, varying by one or more of the factors discussed above. When a container is assembled, one or more of these displacement controllers 30 may be selected and provided between the second resilient member 21 and an edge of the mounting plate 19 to provide a desired performance. For example, the selection may be based on the weight of the artwork, or combined weight of artworks, to be mounted to the mounting panel. For artwork of a greater mass, it may be desirable for the transition from a low stiffness connection to a relatively high stiffness connection to occur at a lower impact force and/or it may be desirable for the stiffness after the transition to be greater.

It will be appreciated that the container described above may be provided as a kit of parts for constructing containers of a variety of different sizes by provided side parts of different lengths and/or connector parts for joining two side parts together end to end. The side parts may be provided in a small number of lengths which have been selected so that containers can be constructed of sizes suitable for accommodating the majority of artworks.

Once a container has been constructed it can be re-used to transport other artwork of a size that can fit on the mounting plate. In some embodiments, the container may also be designed so that is can be dis-assembled, by separating the corner parts and side parts so another container of a different size can be constructed.

For the avoidance of doubt, the verb "comprise" as used herein has its normal dictionary meaning, ie to denote non-exclusive inclusion. The use of the word "comprise" (or any of its derivatives) does not therefore exclude the possibility of further features being included.

All of the features disclosed in this specification (including the accompanying claims, and drawings) may also be combined in any combination (other than combinations where the features are mutually exclusive).

Each feature disclosed in this specification (including the accompanying claims and drawings) may be replaced by alternative features serving the same, equivalent or similar purpose, unless expressly stated otherwise. Thus, unless expressly stated otherwise, each feature disclosed is just an example of a generic series of features providing an equivalent or similar function.

The invention is not restricted to the details of the embodiments described. The invention extends to a container and/or closure which comprises one or more of the features referred to above, or any other novel concept, feature, or combination of the features disclosed herein.

We claim:

1. A container for housing an artwork during transportation or storage, the container comprising:

four side parts and four corner parts for connecting the side parts to form a substantially rectangular frame;

a substantially rectangular lid part and a substantially rectangular mounting panel, each of the side parts having a first recess extending along its length for receiving a respective edge of the lid part and a second recess extending along its length for receiving a respective edge of the mounting panel;

a first resilient member for locating around the perimeter of the lid part between the lid part and the substantially rectangular frame;

a second resilient member for locating around the perimeter of the mounting panel between the mounting panel and the substantially rectangular frame so as to act as a shock absorber between the mounting panel and the substantially rectangular frame;

and securing means for securing the lid part in a closed position relative to the substantially rectangular frame.

2. A container as claimed in claim 1 comprising a substantially rectangular base part, each of the side parts having a third recess extending along its length for receiving a respective edge of the base part, and a third resilient member for locating around the perimeter of the base part between the base part and the substantially rectangular frame.

3. A container as claimed in claim 1 in which the second resilient member is adapted to permit movement of the mounting panel relative to the substantially rectangular frame in three dimensions so as to substantially isolate the mounting panel from shock forces experienced by the container.

4. A container as claimed in claim 1 in which each corner part is securable to the ends of adjacent side parts by fasteners.

5. A container as claimed in claim 1 in which each corner part is integrally formed with a side part and is securable to the end of an adjacent side part by fasteners.

6. A container as claimed in claim 5 in which the substantially rectangular frame comprises two side parts that have an integrally formed corner part.

7. A container as claimed in claim 1 in which said securing means comprises one or more latches mounted on a side member and engageable with a major face of the lid part.

8. A container as claimed in claim 1 in which the side parts are shaped to provide channels for receiving straps encircling the container.

9. A container as claimed in claim 8 in which one or more of the securing means is located in one of the channels so, in use, one of the straps located within the channel lies over the securing means.

10. A container as claimed claim 1 in which the side parts are shaped so that a plurality of similar size containers can be stacked together.

11. A container as claimed in claim 10 in which the corner parts and/or the side parts are shaped so that adjacent containers in a stack of containers interlock with each other.

12. A container as claimed in claim 10 in which at least some of the corner parts are shaped, or have corner extensions fitted thereto, so as to provide feet on which the container can be stood and/or a channel beneath a stack of similar size containers for receiving prongs of a lifting machine.

13. A container as claimed in claim 1 in which the mounting panel is provided with a plurality of retention members to which fastening devices secured to an artwork can be releasably secured.

14. A container as claimed in claim 13 in which the retention members are provided by an array of parallel slots or apertures.

15. A container as claimed in claim 14 in which the retention members are arranged so that artworks of a variety of sizes or shapes can be secured in a selected position on the mounting panel spaced from the side parts of the container.

16. A container as claimed in claim 1, further comprising a displacement controller mounted between the mounting panel and the second resilient member at an edge region of the mounting panel;

wherein the displacement controller includes a protrusion that protrudes away from a major face of the mounting panel and is configured to be in contact with the second resilient member when the mounting panel compresses the second resilient member.

17. A container as claimed in claim 16, wherein the displacement controller is configured such that, when the second resilient member is in an uncompressed state, the protrusion of the displacement controller is not in contact with the second resilient member.

18. A container as claimed in claim 16, wherein at least the protrusion of the displacement controller is formed from a material that is stiffer than the second resilient member.

19. A kit of parts for forming a container as claimed in claim 1.

20. A method of preparing artwork for storage and/or transportation, comprising mounting at least one artwork in a container as claimed in claim 1.

* * * * *